US005669320A

United States Patent [19]

Stewart et al.

[11] Patent Number: 5,669,320

[45] Date of Patent: Sep. 23, 1997

[54] ADJUSTABLE TEMPLATE FOR TEXTILE FINISHING APPARATUS

[75] Inventors: Parks C. Stewart; Robert A. Trobaugh, III, both of Duluth, Ga.

[73] Assignee: Phoenix Automation Inc., Atlanta, Ga.

[21] Appl. No.: 726,242

[22] Filed: Oct. 4, 1996

Related U.S. Application Data

[63] Continuation-in-part of Ser. No. 422,358, Apr. 14, 1995, Pat. No. 5,619,942.

[51] Int. Cl.[6] ..... D05B 21/00; D05B 33/02; D05B 19/00

[52] U.S. Cl. ..... 112/470.07; 112/262.3; 33/23.11

[58] Field of Search ..... 112/470.06, 470.07, 112/262.3, 470.12, 470.13, 320, 475.07; 33/23.11, 23.08

[56] References Cited

U.S. PATENT DOCUMENTS

| | | | |
|---|---|---|---|
| 3,640,235 | 2/1972 | Burton . | |
| 3,774,558 | 11/1973 | Scholl et al. | 112/470.09 |
| 3,970,017 | 7/1976 | Babson et al. . | |
| 4,073,247 | 2/1978 | Cunningham et al. . | |
| 4,134,210 | 1/1979 | Scholl et al. | 112/470.14 |
| 4,296,696 | 10/1981 | Taddicken et al. . | |
| 4,565,362 | 1/1986 | Wiley . | |
| 4,601,249 | 7/1986 | Frye | 112/470.13 |
| 4,608,936 | 9/1986 | Ball et al. . | |
| 4,610,210 | 9/1986 | Kinoshita et al. . | |
| 4,615,287 | 10/1986 | Henze et al. . | |
| 4,621,585 | 11/1986 | Ball et al. . | |
| 4,685,408 | 8/1987 | Frye . | |
| 4,726,501 | 2/1988 | Wiley . | |
| 4,732,096 | 3/1988 | Mall | 112/470.07 |
| 4,748,920 | 6/1988 | Stutzäcker . | |
| 4,926,725 | 5/1990 | Helgesson . | |
| 4,955,307 | 9/1990 | Kolb et al. . | |
| 5,018,462 | 5/1991 | Brocklehurst . | |
| 5,031,553 | 7/1991 | Henze et al. . | |
| 5,095,835 | 3/1992 | Jernigan et al. . | |
| 5,131,339 | 7/1992 | Goodridge . | |
| 5,146,859 | 9/1992 | Conley, Jr. et al. | 112/470.07 X |
| 5,259,329 | 11/1993 | Reedman et al. . | |
| 5,377,605 | 1/1995 | Frye | 112/470.06 |
| 5,400,731 | 3/1995 | Goldbeck et al. . | |

*Primary Examiner*—Andy Falik
*Attorney, Agent, or Firm*—Jones & Askew

[57] ABSTRACT

An adjustable template for maneuvering a textile product. The template includes a template base with several template shoes movably mounted along the sides of the base. The position of the template shoes with respect to the template base is adjusted in response to the detection of the length and the width of the textile product such that when the template is positioned on the product, each template shoe is positioned at a predetermined distance from a lateral edge of the textile product.

21 Claims, 9 Drawing Sheets

ADJUSTABLE TEMPLATE FOR TEXTILE FINISHING APPARATUS

RELATED APPLICATIONS

This application is a continuation in part of Application Ser. No. 08/422,358, filed Apr. 14, 1995, now U.S. Pat. No. 5,619,942.

TECHNICAL FIELD

This invention relates to a method and apparatus for finishing the edges of a textile product. More particularly, the invention measures, cuts, and stitches the edges of a textile product such as a washcloth. The textile product is maneuvered through the apparatus by an adjustable template that changes size according to the size of the textile product.

BACKGROUND OF THE INVENTION

The finishing process for high quality textiles such as washcloths generally has been performed manually because of the attention to detail that is required. The edges of a washcloth must be sewn to prevent fraying and to produce a desirable and lasting product. The process is therefore labor-intensive and time-consuming.

In the manual finishing process, each individual washcloth is cut from a strip of material. The material, typically terry cloth, comes in a continuous strip with transverse borders or "cut lines" present in the fabric at equally spaced intervals along the length of the strip. The cut line is generally an area in the cloth without any terry loops or plush material that represents where each individual washcloth is to be cut from the strip.

After each washcloth is cut, an operator maneuvers the washcloth around a sewing head to stitch or over-edge the sides. A high amount of operator skill is required to produce a washcloth with four uniform sides because the dimensions of each side of the material can often vary. Rounded-corner washcloths are particularly difficult to finish because each corner of the washcloth must be rounded in a uniform fashion. UPC labels, cloth loop labels, or single-ply labels also may be added to the edges of the washcloth.

While attempts have been made to automate the washcloth finishing process, these attempts have not been successful with respect to quality control and with respect to production time because of the lack of uniformity in the material. For example, the center of the corner radius of a washcloth should be positioned to an accuracy of less than 0.060 to 0.100 inches. If the dimensions of the washcloth differ by more than this amount in either length or width, as is often the case, the corners will not be properly stitched and the labels will not be properly attached.

Attempts to automate the washcloth finishing process include U.S. Pat. No. 4,685,408 to Frye, disclosing the use of a plate to guide a pre-cut washcloth into a rotating sewing head. Frye, however, simply finishes each washcloth to a standard dimension and thus does not accommodate the dimensional variations of each washcloth. Further, Frye does not have the ability to change the center of rotation at the corners of the washcloth because of the mechanically-fixed rotation. Smaller washcloths generally need smaller corner radii. The use of a rotating sewing head is also disfavored by the industry because of the thrust and lateral loads that are created within the sewing head. The centrifugal forces imparted to the sewing head impair lubricant dispersal and the associated cooling effects such that high maintenance is required.

Other attempts to automate the washcloth finishing process include U.S. Pat. No. 5,018,462 to Brocklehurst. Brocklehurst discloses the maneuvering of a washcloth around a sewing head by the use of a rotating plate controlled by optical sensors. Rotation of the plate is activated by a sensor detecting a corner of the washcloth and continues until the next corner is detected. The desired position for the center of the radius of each corner, however, may not be the same for all four corners of the washcloth. Rather than accommodating the actual dimensions of the entire washcloth, the apparatus of Brocklehurst simply finishes each corner on same axis of rotation.

The size of the template used in maneuvering the washcloth through the automated system is also a concern. If the template is too small as compared to the washcloth, the fabric tends to bunch up during the finishing process. Similarly, the quality of the finish will suffer if the edges of the template are too close to the edges of the washcloth or if the template interferes with the sewing head. It is a time consuming and labor intensive process to change manually the template to match the size of an individual washcloth.

What is needed therefore is a means for accommodating nonuniform textile products into an automated finishing system. Without this ability to adapt to the dimensions of each individual washcloth, even minor variations in the raw material can lead to an unsatisfactory product.

SUMMARY OF THE INVENTION

Stated generally, the invention comprises an adjustable template for maneuvering a textile product. The template includes a template base with several template shoes movably mounted along the sides of the base. The position of the template shoes with respect to the template base is adjusted in response to the detection of the length and the width of the textile product such that when the template is positioned on the product, each template shoe is positioned at a predetermined distance from a lateral edge of the textile product.

The method the present invention includes the steps of detecting the length and width of the textile product and then adjusting accordingly the position of the template shoes with respect to the template base. The template then contacts the textile product and moves it along a predetermined path.

Specific embodiments of the invention include positioning the template shoes on the lateral sides of the template base, generally on opposing parallel sides. The means for adjusting the position of the template shoes includes a linkage mechanism and a drive means. The linkage mechanism may be a ball screw mechanism or other type of mechanical linkage. The drive means may be a reversible motor or other type of drive mechanism. Each linkage mechanism is in driving connection with two of the opposing, parallel template shoes such that the shoes move in tandem. The drive means powers the linkage mechanism to maneuver the template shoes with respect to the template base to a predetermined distance from the edge of the textile product.

The template shoes may be attached to a plurality of adjustable arms that are slidably attached to the template base. At least two of the adjustable arms form a set of opposing arms. Each adjustable arm of the set is connected by a linkage mechanism. The drive means powers the linkage mechanism such that each adjustable arm is maneuvered in tandem with one another to position the template shoes with respect to the template base.

An optical sensor is used for detecting the length and the width of the textile product. A controller activates the drive means in response to the determination of the length and width of the textile product.

Thus, it is an object of the present invention to provide an improved method and apparatus for finishing a textile product.

It is another object of the invention to provide an improved method and apparatus for finishing a washcloth.

It is a further object of this invention to provide an automated method and apparatus for finishing washcloths that will accommodate washcloths of varying dimensions.

It is a still further object of the present invention to provide a method and apparatus to determine accurately the length and width of a textile product.

It is a still further object of the present invention to provide an adjustable template for use in finishing textile products.

It is a yet another object of this invention to provide an adjustable template that can accommodate textile products of varying sizes.

It is a yet another object of this invention to provide an adjustable template that can accommodate textile products of varying sizes by matching the size of the textile product.

Other objectives, features and advantages of the present invention will become apparent upon reading the following specification, when taken in connection with the drawings and the claims.

DETAILED DESCRIPTION

Figure 1:
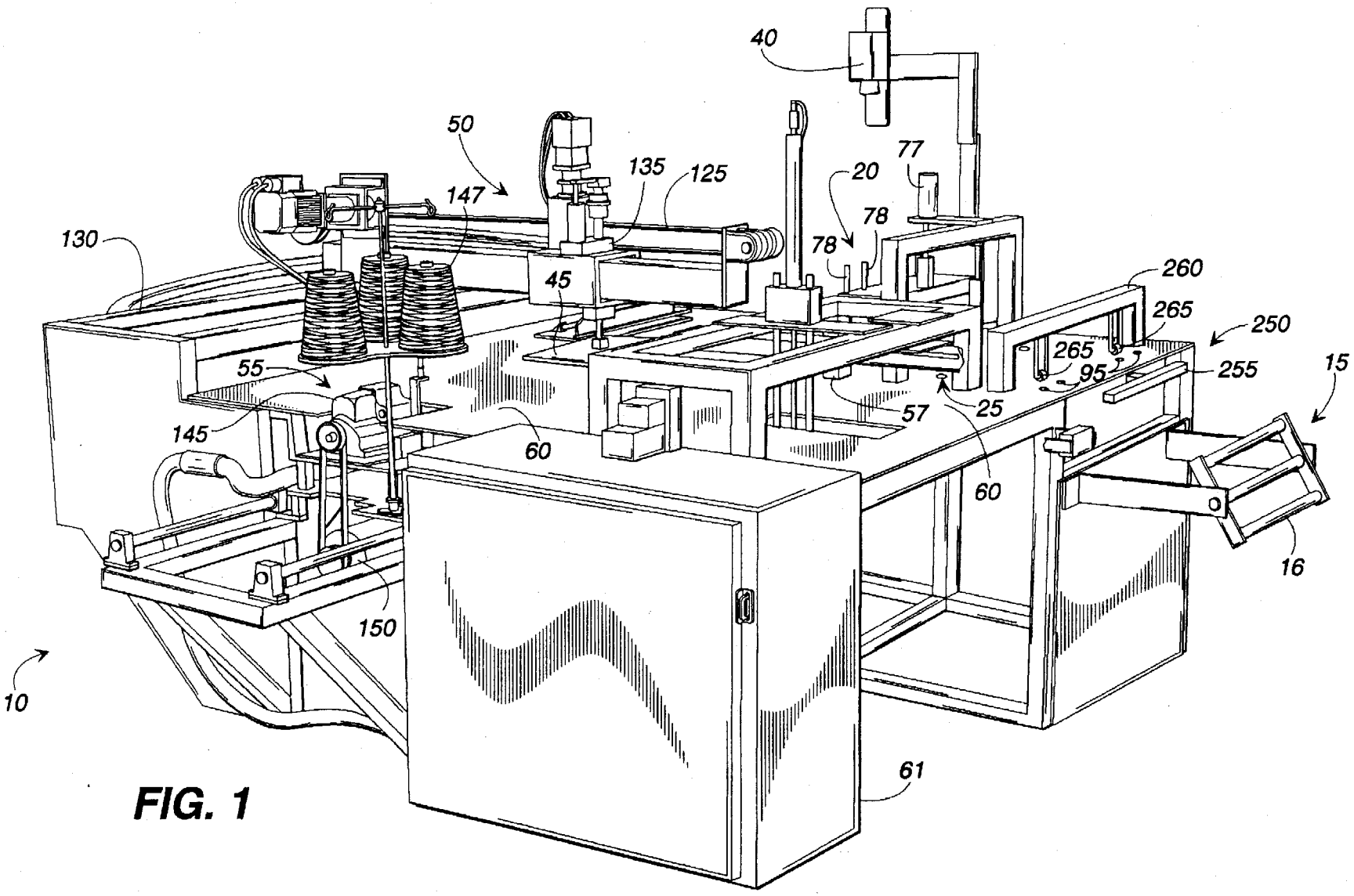
FIG. 1 is a perspective view showing the major elements of the preferred embodiment of the invention.
Figure 2:
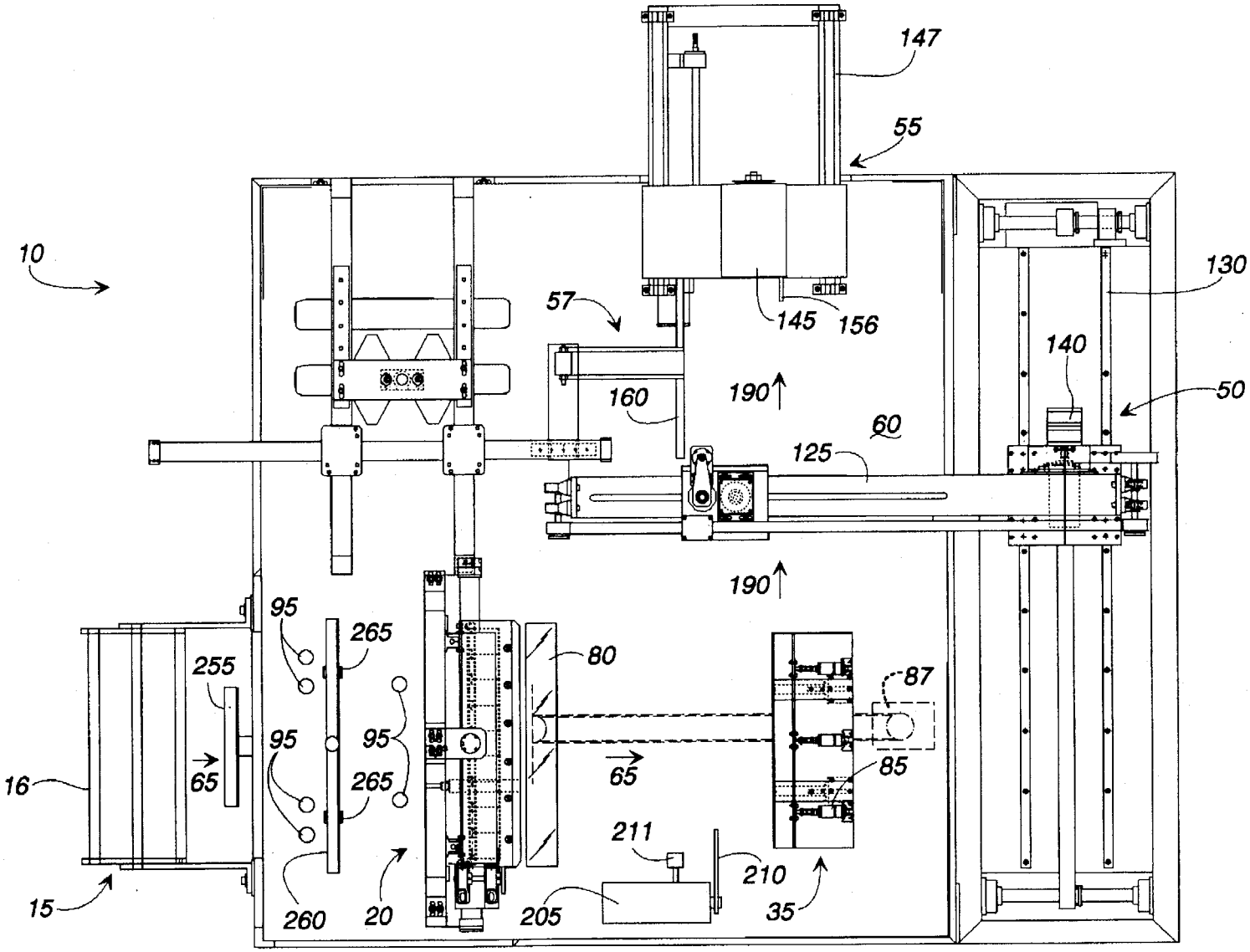
FIG. 2 is a plan view of the tabletop with the major elements of the preferred embodiment of the invention.
Figure 3:
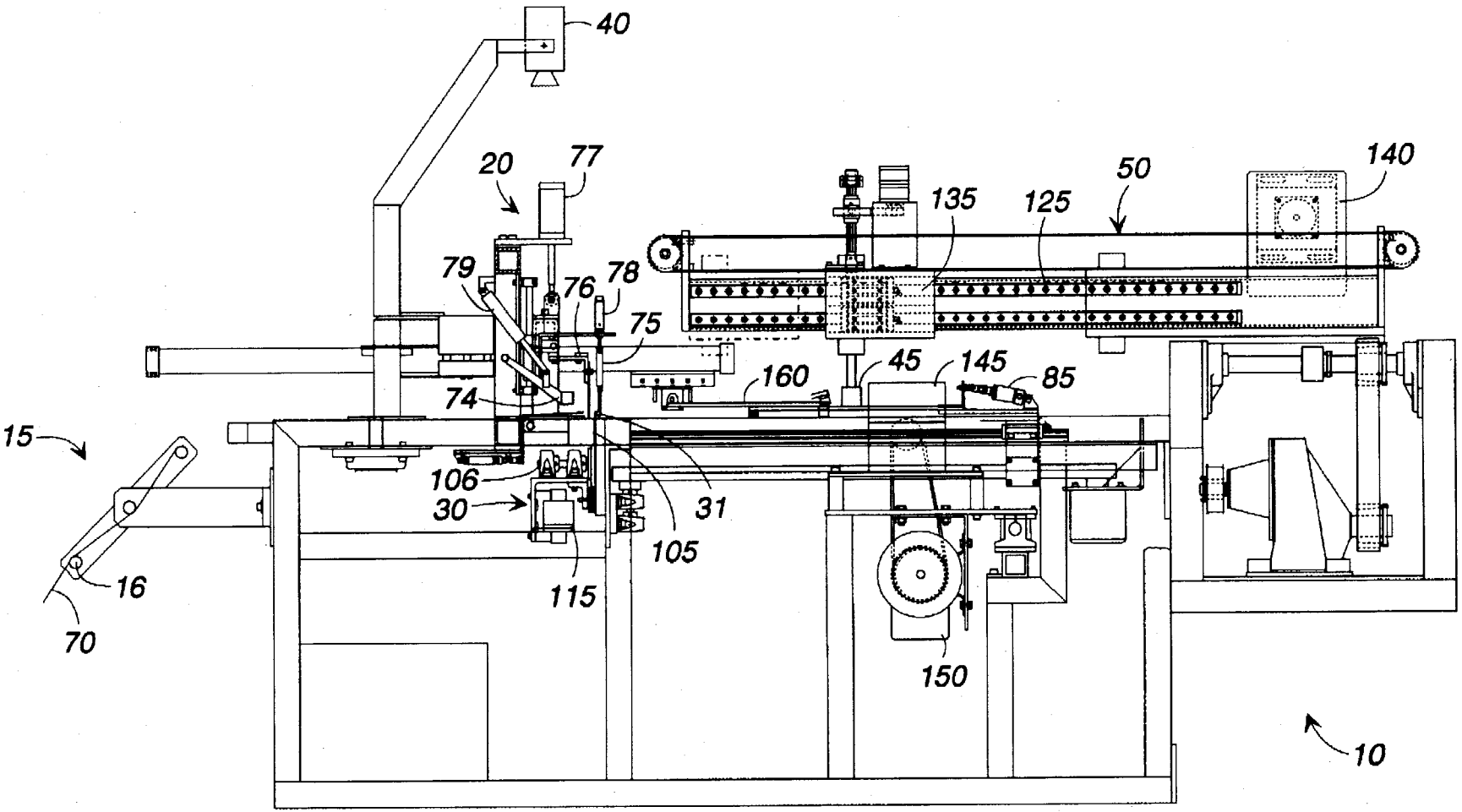
FIG. 3 is a side view of the tabletop, the intake assembly, the straightening gantry, the camera, the cutting assembly, the pull back assembly, the template, and the gantry frame assembly.

Referring to the drawings, in which like numerals represent like parts throughout the several views, FIGS. 1 through 7 show the preferred embodiment of a washcloth finishing apparatus 10. FIGS. 1 through 3 show the major elements of the apparatus 10. This embodiment of the invention employs the use of an intake assembly 15, a straightening gantry assembly 20, a detector assembly 25, a cutting assembly 30, a pull back assembly 35, a camera 40, a template 45, a gantry frame assembly 50, a sew area assembly 55, and a removal assembly 57. All of these elements are mounted on a table top 60 in sequential fashion as shown. Further, the table top 60 may contain multiples of any of the above-referenced elements, such as two intake assemblies 15, straightening gantry assemblies 20, detector assemblies 25, cutting assemblies 30, pull back assemblies 35, cameras 40, templates 45, and removal assemblies 57, cooperatively operating with a single or multiple sew area assemblies 55.

The operation of the invention as a whole is governed by an axis CNC controller 61. The controller 61 may be a Delta Tau PMAC-PC model motion controller system with an eight axis servo control card, manufactured by Delta Tau Data Systems, or a similar type of system.

The intake assembly 15 is mounted at one end of the table top 60 along an intake path 65. The intake assembly 15 accommodates a continuous strip 70 of terry cloth or other material as it is fed into the assembly 10. The intake assembly 15 has a set of bars 16 through which the continuous strip 70 is guided onto the intake path 65 on the table top 60.

Figure 8:
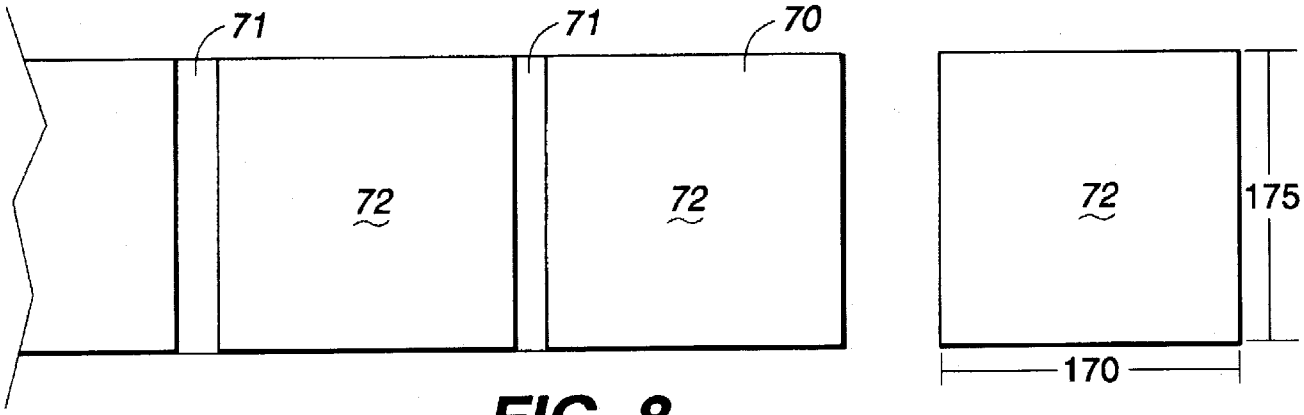
FIG. 8 is a plan view of a washcloth and the continuous strip of terry cloth material.

The continuous strip 70 is generally layered within a buggy or mounted in roll form. As is shown in FIG. 8, the continuous strip 70 has transverse borders or cut lines 71 present in essentially uniform intervals. The cut line 71 is an area in the continuous strip 70 with no terry loops or other plush material. The cut line 71 also may include a small gap or gaps in the fabric. The cut line 71 indicates where the continuous strip 70 is to be cut to form an essentially rectangular or square panel. In this embodiment, the panel is in the form of a washcloth 72.

Figure 4:
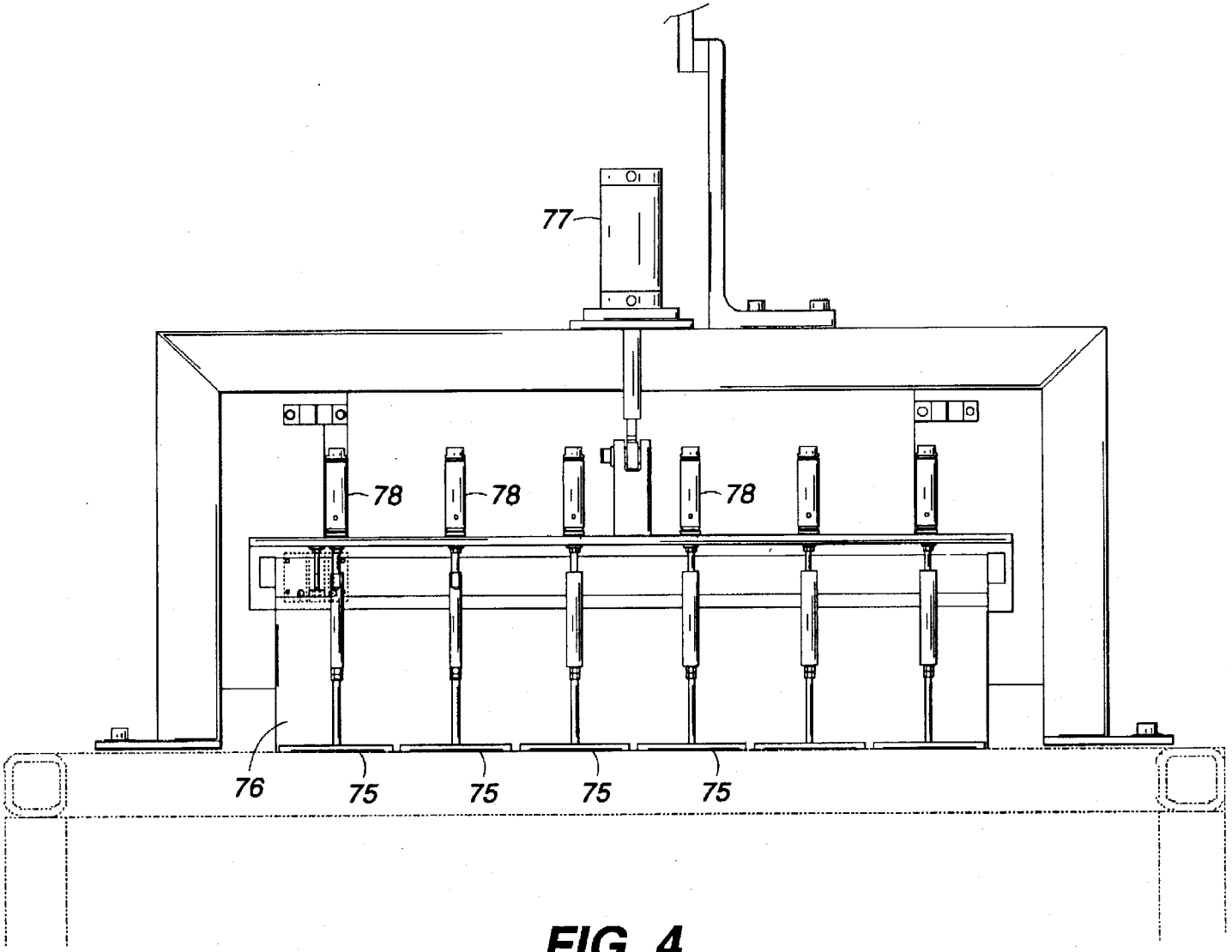
FIG. 4 is a front view of the straightening assembly.
Figure 5:
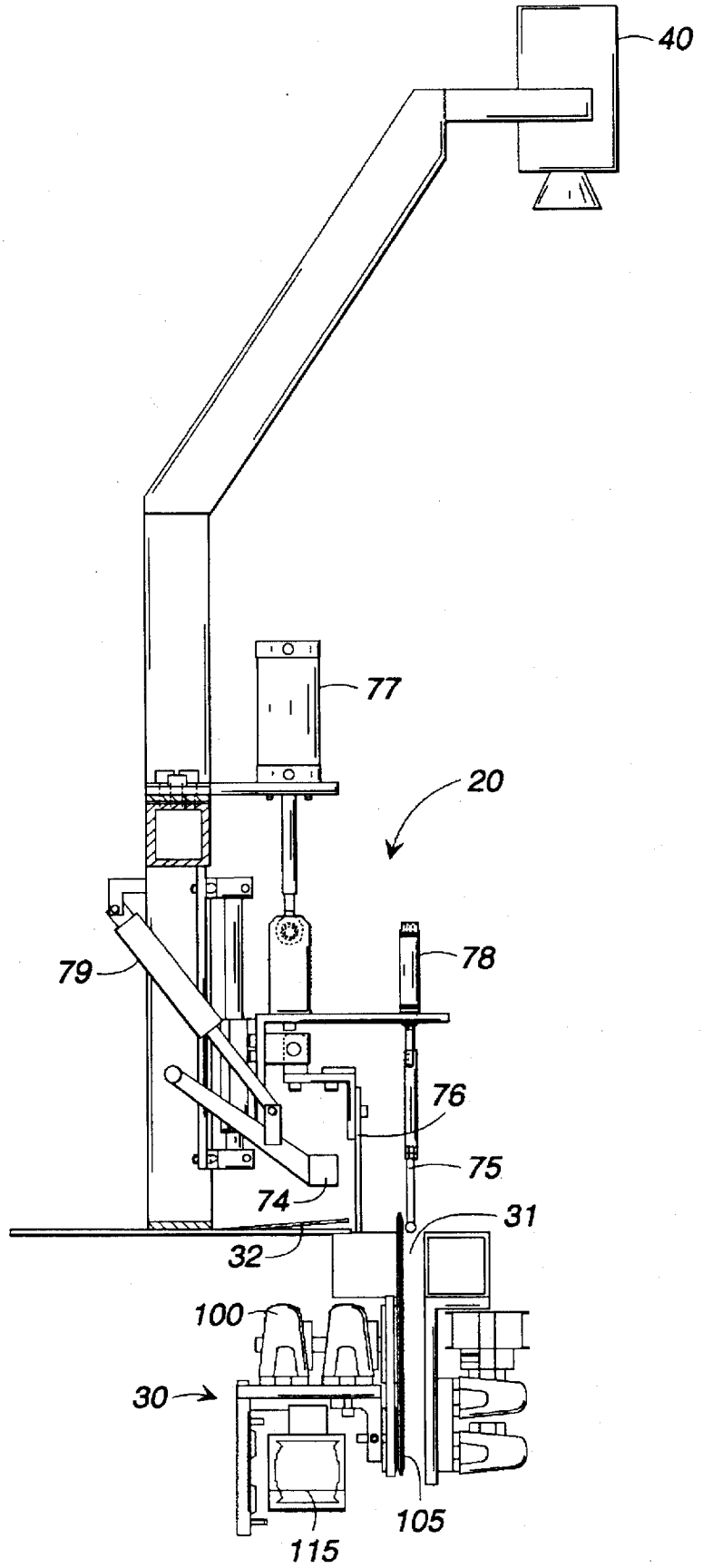
FIG. 5 is a side view of the straightening assembly, the cutting assembly, and the camera.
Figure 6:
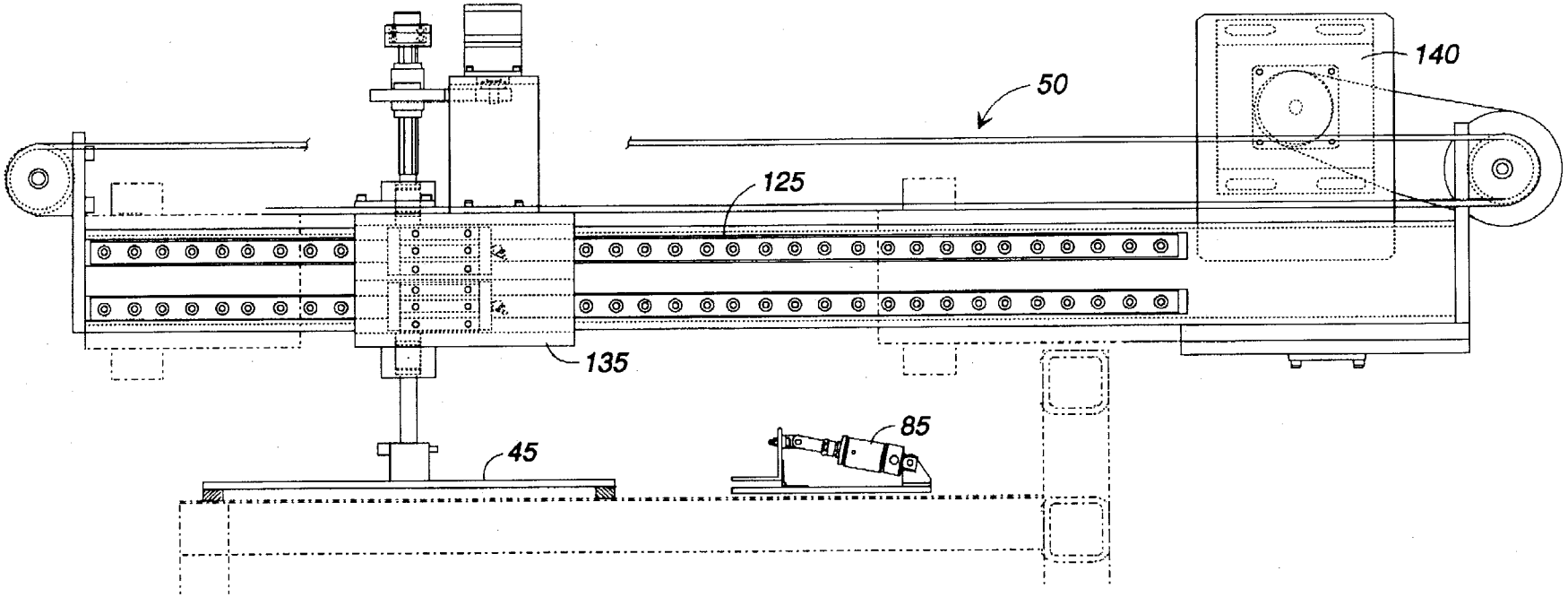
FIG. 6 is a side view of the pull back assembly, the template, and the gantry frame assembly.

As is shown in FIGS. 4 and 5, the straightening gantry assembly 20 is mounted to the table top 60 along the intake path 65. The straightening gantry assembly comprises a holding bar 74 with a holding bar air cylinder 79, several mechanical pusher rods 75 with pusher rod air cylinders 78, and a straightening plate 76. The mechanical pusher rods 75 and the straightening plate 76 are in turn mounted to an assembly air cylinder 77.

The mechanical pusher rods 75 are generally in the shape of a inverse "T" and are positioned over a recess 31 adjacent to the cutting assembly 30. The straightening plate 76 is rectangularly shaped and extends the width of the intake path 65. The pusher rods 75 and the straightening plate 76 are powered by the assembly air cylinder 77 for up and down motion therewith. The pusher rods 75 are further powered by the pusher rod air cylinders 78 for extended motion into the recess 31. The holding bar 74 is positioned behind the straightening plate 76 and is powered for up and down motion by the holding bar air cylinder 79.

As is shown in FIG. 4, the camera 40 is mounted upon the straightening gantry assembly 20 such that the camera 40 has a view of the intake path 65 from the straightening gantry assembly 20 to the pull back assembly 35. The camera 40 can be any kind of conventional camera, photo-eye, or other optical monitoring device. The intake path 65 has a reflective surface 80, such as a piece of reflective tape, thereon to ensure that the camera 40 can differentiate between the intake path 65 on the table top 60 and the continuous strip 70.

The pull back assembly 35 is mounted on the table top 60 along the intake path 65. The pull back assembly 35 comprises a feed pull gripper 85 attached to a servo motor 87. More than one feed pull gripper 85 may be employed within the pull back assembly 35. The feed pull gripper 85 grabs the continuous strip 70 as it is emerges from the straightening gantry assembly 20 and pulls the continuous strip 70 along the intake path 65 through the cutting assembly 30 and onto a predetermined location on the table top 60.

The detector assembly 25 determines the location of the cut line 71 and other boundaries of the washcloth 72. The detector assembly 25 includes two optical sensors 95 positioned along the intake path 65 of the table top 60. In this embodiment, the optical sensors 95 are analog photo-eyes that can detect changes in the thickness or density of the continuous strip 70. The analog output of the optical sensors 95 to the controller 61 changes proportionally to the thickness or density of the cloth. The optical sensors 95 can be used with any thickness or color of cloth. Alternatively, any type of detector controls may be employed, including optical, electrical, or pneumatic. One or more detector assemblies 25 may be used.

In connection with the detector assembly 25, the straightening gantry assembly 20 also may include a bias correction device 250 to ensure that the position of the cut line 71 is straight as it approaches the cutting assembly 30. The bias correction device 250 comprises a straightening bar 255 mounted on the table top 60 adjacent to the intake assembly 15, and an edge guide apparatus 260 positioned between the straightening bar 255 and the cutting assembly 30. The bias correction device 250 also employs the use of the optical sensors 95. Because at least two optical sensors 95 are used, the sensors 95 also can determine whether the cut line 71 is perpendicular to the intake path 65. Any angle or bias in the cut line 71 can be determined by measuring the timing of the change in output of the two sensors 95. This difference causes the controller 61 to tilt the straightening bar 255 in one direction or another to compensate for the bias in the continuous strip 70.

The edge guide apparatus 260 comprises two rotatable wheels 265 that descend along the edge of the continuous strip 70 to ensure that the absolute edges on both sides of the continuous strip 70 remain along the same line. The edge guide apparatus also comprises several additional optical sensors 95 positioned along the edge of the continuous strip 70 because the continuous strip 70 tends to move to the right or the left when the straightening bar 255 corrects the bias therein. The optical sensors 95 detect any drift in the continuous strip 70 and activate the rotatable wheels 265 accordingly.

The cutting assembly 30 is shown in FIG. 5. As is shown in FIGS. 1 and 2 the cutting assembly 30 is positioned under the table top 60 in the middle of the recess 31 in the intake path 65. The intake path 65 has a raised plate 32 positioned thereon just prior to the recess 31. The cutting assembly 60 comprises a blade 105 powered by an electrical motor 106. The blade 105 is also attached to and activated by a cutting blade air cylinder 115 for reciprocal movement along the recess 31. The blade 105 is activated for movement along the recess 31 by a signal from the controller 61 to coincide with the depression of the pusher rods 75 to accurately cut the washcloth 72.

The gantry arm assembly 50 is positioned on the table top 60 and comprises a gantry arm 125, one or more fixed rails 130, a template frame 135, and the template 45. The template 45 is operably mounted within the template frame 135 for rotation about the Z, or vertical, axis. The template 45 also can be raised or lowered towards the table top 60 so as to engage the washcloth 72. The template frame 135 is supported by the gantry arm 125 for movement thereon along the Y axis. The gantry arm 125 is mounted on the one or more fixed rails 130 for movement thereon along the X axis. The result is that the template 45 can maneuver along the X, Y, and Z axes and also rotate about the Z axis. The template 45 is powered by one or more electrical drive motors 140. The drive motors 140 are governed by directional instructions received from the controller 61 such that the washcloth 72 is maneuvered along a calculated path 190, described below.

Figure 7:
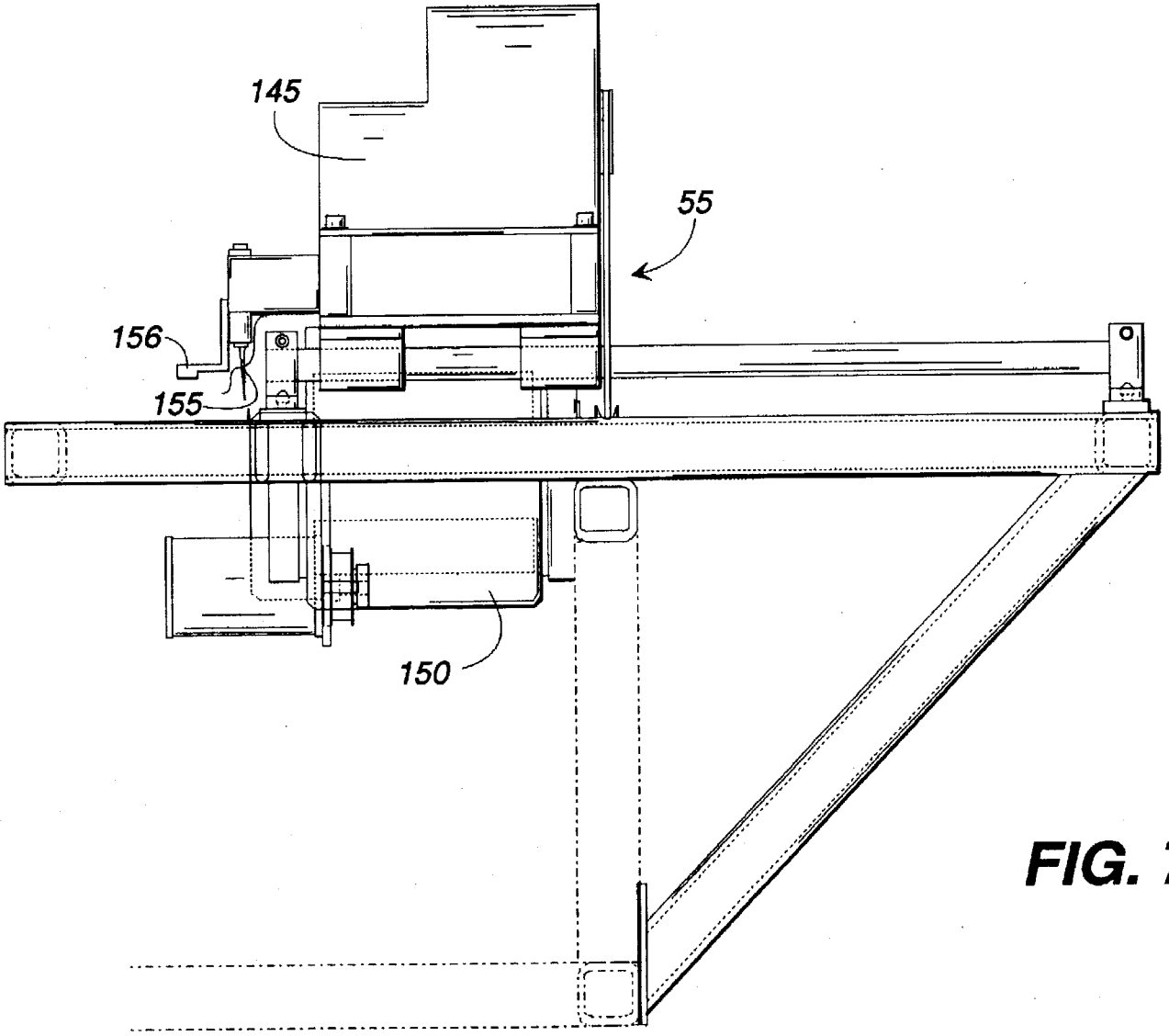
FIG. 7 is a side view of the sewing assembly.

The sew area assembly 55 is also mounted on the table top 60 as is shown in FIG. 7. The sew area assembly 55 includes a sewing head 145 powered by a sewing motor 150. The sewing motor 150 is generally a two horsepower electrical motor. A Mauser brand or similar sewing head may be employed. The sewing head 145 is fed with thread from spindles 147. The sewing head 145 may be equipped with an integral blade 155 and a spring-loaded tracking arm 156. The sew area assembly 55 also may be equipped with more than one sewing head 145 depending upon the number of elements mounted on the table top 60. Further, more than one type of sewing head 145 may be employed to give the apparatus 10 versatility in accommodating various types of washcloths 72.

The removal assembly 57 is mounted on the table top 60 adjacent to the sew area assembly 55. The removal assembly 57 comprises a "T" shaped engagement arm 160 capable of reciprocal movement. The engagement arm 160 engages the washcloth 72 by pulling it along the table top 60 after the template 45 has maneuvered the washcloth 72 around the sewing head 145. The engagement arm 160 pulls the washcloth along the table top 60 to a predetermined placement location.

In the preferred embodiment of FIGS. 1 through 7, the washcloth finishing apparatus 10 processes the continuous strip 70 in sequential fashion. The continuous strip 70 is positioned in the intake assembly 15 and advanced along the intake path 65. One end of the continuous strip 70 is fed into the straightening gantry assembly 20 and engaged by the feed pull gripper 85. The straightening gantry assembly 20 ensures that the incoming cut line 71 on the continuous strip 70 is perpendicular to the intake path 65 and parallel to the cutting assembly 30 by the use of the straightening plate 76. The straightening plate 76 descends upon the fabric and intersects the cut lines 71. The cut lines 71 are forced against the plate 76 as the feed pull gripper 85 pulls the continuous strip 70 forward to remove any angle or bow that may be present. The pusher rods 75 then descend and force the continuous strip 70 into the recess 31 adjacent to the cutting assembly 30. The holding bar 74 secures the continuous strip 70 behind the straightening plate 76 to ensure that the continuous strip 70 remains in place as the washcloth 72 is cut.

As the continuous strip 70 advances along the intake path 65, the location of each cut line 71 is determined by the optical sensors 95 of the washcloth detector assembly 25. The cut line 71 is of lesser density then that of the surrounding plush fabric of the continuous strip 70. The optical sensors 95 determine the position of the cut line 71 by sensing the change in density of the continuous strip 70. When the cut line 71 passes over the optical sensors 95, the output of the sensors 95 changes in magnitude and duration. This change is monitored and the position of the cut line 71 is determined by the controller 61.

This determination of the position of cut line 71 by the optical sensors 95 also may be used by the bias correction device 250 to further ensure that the cut line 71 is straight before the continuous strip 70 reaches the cutting assembly 30. Any difference in the timing of the detection of the cut line 71 by the respective optical sensors 95 causes the straightening bar 255 to correct the bias in the continuous strip 70 by tilting in the opposite direction from the bias. The edge guide apparatus 260 keeps the edges of the continuous strip 70 in line while the straightening bar 255 is tilted.

As the continuous strip 70 is advanced by the feed pull gripper 85 through the cutting assembly 30, the blade 105 is triggered by the determination of the position of the cut line 71. The controller 61 is aware of the exact position of the cut line 71 at all times based upon the detection of the cut line 71 by the detector assembly 25. Based upon this information, the feed pull gripper 85 advances the continuous strip 70 such that the blade 105 cuts an individual washcloth 72 exactly at the location of the cut line 71. The washcloth 72 is then pulled by the feed pull gripper 85 to a predetermined location at the intersection of the end of the intake path 65 and the beginning of the calculated path 190 and released.

The length 170 of each washcloth 72 is calculated based upon the determination of the location of the cut line 71. The controller 61 calculates the exact length 170 of each washcloth 72 based upon the position of the feed pull gripper 85 along the intake path 65 at the time the detector assembly 25 senses the presence of a cut line 71, in combination with the known amount of advance of the feed pull gripper 85.

The width 175 of each individual washcloth 72 is also determined as the continuous strip 70 advances along the intake path 65. The width 175 is measured by the overhead camera 40 mounted to the straightening gantry assembly 20. The intake path 65 has a reflective surface 80 thereon such that the camera 40 can locate the edges of each washcloth 72 and measure the width 175. Approximately three measurements are taken for the width 175 of each washcloth 72 as the continuous strip 70 is advanced. These sums are averaged and the width 175 of each washcloth 72 is determined by the controller 61. The camera 40 can be any type of device by which the perimeter of each washcloth 72 can be determined, such as video monitoring, imaging, or the use of a photo-electrical beam.

Based upon the determination of the length 170 and the width 175 for the washcloth 72, and the distance traveled by the feed pull gripper 85, the exact center 185 of the washcloth 72 is also known. The washcloth 72 is then engaged at its center 185 by the template 45 associated with the gantry frame assembly 50. The template 45 maneuvers the washcloth 72 along the calculated path 190 into position in the sewing area assembly. As described above, the gantry arm 125, in combination with the template 45, permits maneuvering of the washcloth 72 along the calculated path 190 in both the X and the Y axes. The template 45 also can rotate about the Z axis within the template frame 135.

Once the washcloth is maneuvered into position in the sewing area 55, the template 45 rotates the washcloth 72 around the sewing head 145 to finish the edges and the corners of the washcloth 72. The sewing head 145 stitches each edge of the washcloth 72 based upon the determination of the length 170 and the width 175. The corners of each washcloth 72 are also automatically rounded. Another camera 40 or further optical sensors 95 also can be located over the sew area assembly 55 and provide information regarding out of square edges on the washcloth 72. In this embodiment, optical sensors 95 are mounted adjacent to the sewing head 145. Out of square edges are detected by the optical sensors 95 and are compensated for as the washcloth 72 is maneuvered around the sewing head 145.

By positioning two optical sensors 95 adjacent to the sewing head 145, the sensors 95 can also detect the exact location of a corner of the washcloth 72 so as to accurately cause the template 45 to begin to rotate. As the turn is completed, the optical sensors 95 accurately detect the position and depth of the next side of the washcloth 72. In this manner, any angle in the washcloth 72 is accounted for to ensure that the sewing head 145 does not does not miss an edge or a corner and the washcloth 72 is evenly finished.

As the sewing head 145 advances around the washcloth 72, the sewing head 145 is kept in position with the help of the tracking arm 156. The tracking arm 156 rides along the template 45 and forces the template 45 to hold the washcloth 72 in position. When each edge of the washcloth 72 is finished, the sewing head 145 "sews off" or slightly overlaps the stitches to prevent the stitches from unraveling. As the washcloth 72 is maneuvered around the sewing head 145, the integral blade 155 also cuts away any excess material.

Figure 9:
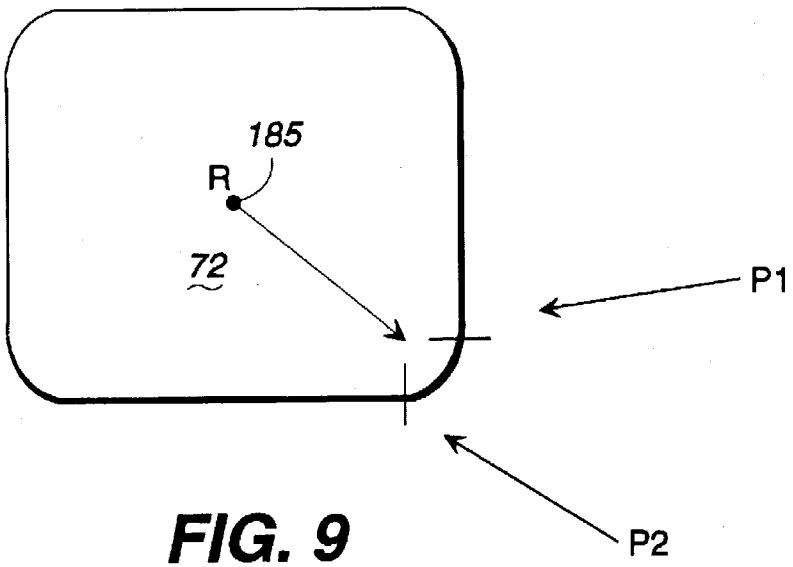
FIG. 9 is a plan view of a washcloth.

As is shown in FIG. 9, the starting point of the arc P1, the center of rotation R, and the ending point of the arc P2 are calculated for each corner of the washcloth 72 using the known speed of the template 45 and other experimentally-determined coordinates. The operator of the apparatus 10 also has the ability to modify the position of the starting point of the arc P1. This gives the operator the ability to control how "round" a given corner is finished. The operator also can change the speed in which the sewing head 145 advances along the sides of the washcloth 72 to accommodate washcloths 72 of varying thickness and density.

The engagement arm 160 of the removal assembly 57 then engages the washcloth 72 and pulls it to the side of the table top 60 for removal from the apparatus 10. The removal assembly 57 also may drop the washcloth 72 into a holding area (not shown) for stacking.

By determining the dimensions of the washcloth 72 to a high degree of accuracy, the apparatus 10 is also able to insert labels 200 onto the edges or corners of the washcloth 72. A label insertion apparatus 205 with a rotating arm 210 may be positioned adjacent to the intake path 65. As the washcloth 72 is released by the feed pull gripper 85 at the predetermined location, the rotating arm 210 of the label insertion apparatus 205 may place a label 200 on one side of the washcloth 72. The template 45 secures the label 200 on the washcloth 72 and the label 200 is sewn into position as the washcloth 72 travels around the sewing head 145. Alternatively, the label insertion apparatus may include a plate 211 in which the labels 200 are positioned. The plate 211 is extended by the label insertion apparatus 205 into position over the washcloth 72 where the plate 211 releases the label 200. More than one label 200 can be inserted on a washcloth 72.

As an alternative embodiment, the sewing head 145 itself is capable of rotation about the Z axis. The movement of the template 45 can then be limited to two directions of movement. The template 45 advances the washcloth 72 adjacent to the sewing head 145 and the controller 61 then guides the sewing head 145 and the template 45 based upon the predetermined length 170 and width 175 dimensions.

Further, the camera 40 or other detection device also can be located over the sew area assembly 55 and receive information on both the length 170 and the width 175 of the washcloth 72. This information on the dimensions of the washcloth 72 may then be used by the controller 61, as described above, to guide the washcloth 72 through the sewing head 145. The camera 40 can determine the dimensions of the entire washcloth 72 to guide the template 45 and the washcloth 72 around the sewing head 145 regardless of the means for cutting each washcloth 72 from the continuous strip 70. Likewise, the sewing head 145 itself can maneuver in and out to compensate for variations in the edges. By using this information, the sewing head 145 can track and follow the actual edge of the washcloth 72.

The result of these embodiments is an apparatus 10 capable of producing a high quality washcloth 72 finished to its exact dimensions. Such a finish is ensured by the determination of the dimensions of each washcloth 72 by the controller 61 to guide the template 45. The controller 61 can react to varying dimensions and also permit size changes without the need for mechanical alterations to the apparatus 10. The apparatus 10 can finish the edges of washcloths 72 ranging in length from 11 to 15 inches. An average of 6 to 6.5 washcloths per minute can be produced based upon a 12 inch washcloth 72.

The Adjustable Template

Figure 10:
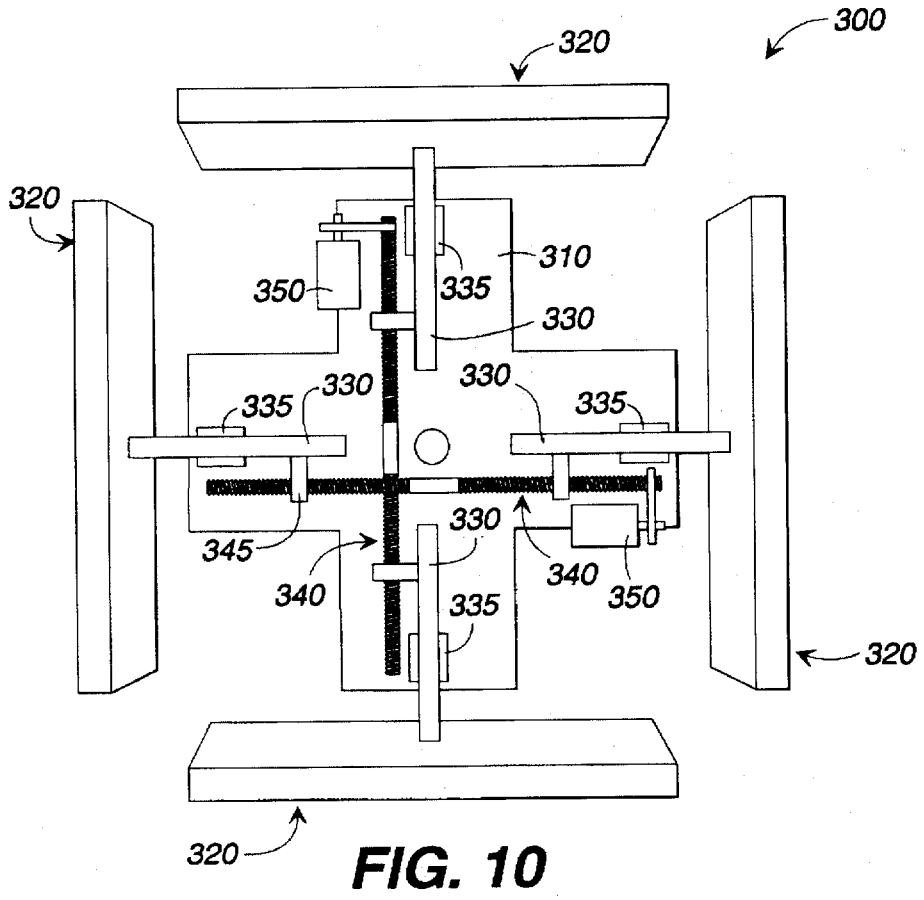
FIG. 10 is a plan view of the adjustable template.
Figure 11:
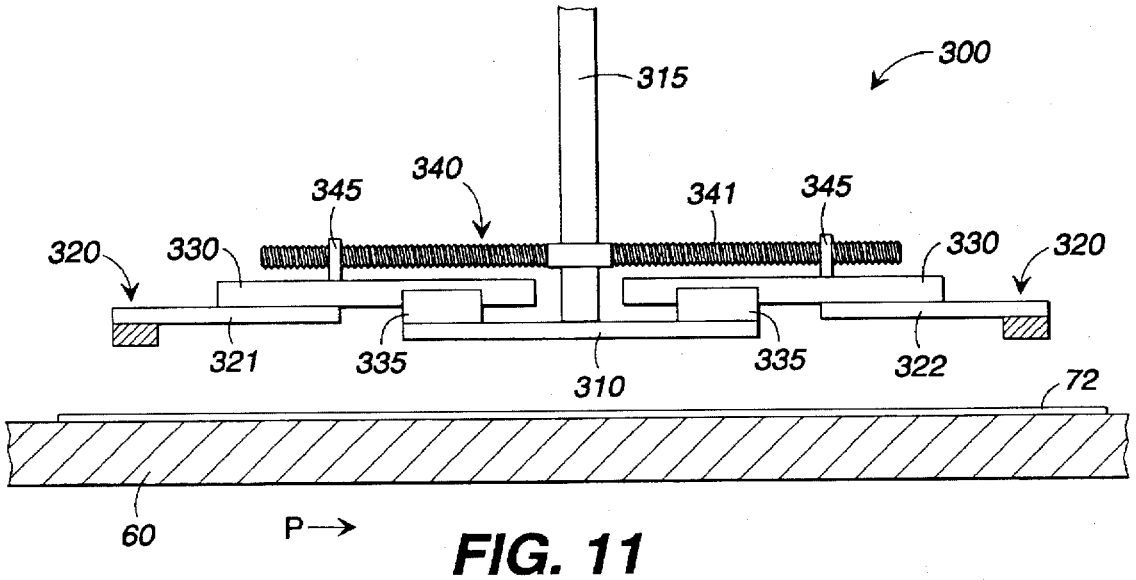
FIG. 11 is a side view of the adjustable template.

An alternative embodiment of the template 45 is an adjustable template 300. As is shown in FIGS. 10 and 11, the adjustable template 300 has a fixed template base 310 with one or more template shoes 320. The fixed base 310 has a smooth bottom end for contact with the washcloth 72 and can be of any desired length or width. The fixed base 310 is attached to the template frame 135 via a shaft 315. The template shoes 320 likewise each have a smooth bottom end for contact with the washcloth 72 and can be of any practical width. The length of the template shoes 320 is generally similar to the length of the corresponding edge of the fixed base 310. The overall size of the adjustable template 300 in general and the template shoes 320 in specific may vary with the size and the material of the washcloth 72.

Each template shoe 320 is attached to the fixed base 310 via an adjustable arm 330 or other type of sliding or adjustable mechanism. One end of the adjustable arm 330 is fixedly attached to the template shoe 320, or alternatively, the adjustable arm 330 and the template shoe 320 may be one unitary piece. The other end of the adjustable arm 330 is slidably engaged with the fixed base 310 through engagement with a groove 335. The groove 335 is fixedly attached to the fixed base 310.

The template shoes 320 and the adjustable arms 330 are maneuvered with respect to the fixed base 310 through the groove 335 by a linkage mechanism 340. The linkage mechanism 340 includes a ball screw mechanism, a rack and pinion system, a belt system, or similar type of mechanical linkage. In the example of a ball screw mechanism 341, the mechanism 341 is threaded and is connected to the adjustable arm 330 via a threaded screw guide 345. The threaded screw guide 345 is fixedly attached to the adjustable arm 330.

Preferably, one template shoe 320 is positioned on each lateral edge of the fixed base 310, such that the position of the template shoes 320 with respect to the template base 310 can be maneuvered in parallel via the linkage mechanism 340. For example, left handed template shoe 321 and right handed template shoe 322 are connected via the linkage mechanism 340. The linkage mechanism 340 moves the left handed template shoe 321 and right handed template shoe 322 together in parallel either away or towards the template base 310.

The linkage mechanism 340 may be driven by drive means 350 or may be manually operated. The drive means 350 are governed by directional instructions received from the controller 61. The drive means 350 can include a servo, stepper, or similar type of motor. The motor may be reversible or unidirectional with appropriate gearing. Other possible drive means 350 include the use of hydraulics, electromagnetics, or other types of conventional drive means known to those skilled in the art. The drive means 350 can be directly mounted onto the fixed base 310. Preferably, each pair of opposing template shoes 320 is driven by a single drive means 350.

In use, information concerning the length 170 and the width 175 of each individual washcloth 72 is used to determine the applicable positioning of the template shoes 320 with respect to the template base 310. The length 170 and the width 175 of the washcloth 72 is detected by the optical sensors 95 and/or the camera 45 as described above. The controller 61 uses this information to signal the drive means 350 to drive the linkage mechanism 340 to adjust the positioning of the template shoes 320 in accordance with the detected size of the washcloth 72. For example, the controller 61 would instruct the drive means 350, a reversible stepper motor, to drive the linkage mechanism 340 a given number of steps in a given direction. The template shoes 320 are positioned to ensure that each template shoe 320 is a pre-determined distance away from each edge of the washcloth 72. For example, each template shoe 320 would be positioned approximately 1-½ inches away from each edge of the washcloth 72.

The quality of the finish is dependent upon the correct distance of the each template shoe 320 from the edges of the washcloth 72. The template 300 therefore can be adjusted to accommodate small variations in size among individual washcloth 72 of approximately the same size or to accommodate overall size changes, i.e., going from a six inch by six inch washcloth to a nine inch by nine inch washcloth.

While the invention has been disclosed as finishing the edges of terry cloth washcloths, other types of fabric and materials can be used. Likewise, the invention can finish the edges of products other than washcloths, such as napkins, towels, place mats, floor mats, rags, and the like.

We claim:

1. In combination with a means for detecting the length and width of a textile product with lateral edges, an adjustable template for maneuvering the textile product along a predetermined path, wherein said detecting means is positioned along said predetermined path and said template is mounted for movement along said path;

said template comprising a template base with lateral sides and a plurality of template shoes movably mounted along said lateral sides of said template base; and means for adjusting the position of said template shoes with respect to said template base in response to said detection of said length and said width of said textile product such that when said template is positioned on said textile product, said template shoes are positioned a predetermined distance from said lateral edges of said textile product.

2. The adjustable template of claim 1, wherein said means for detecting said length and said width of said textile product comprises an optical sensor.

3. The adjustable template of claim 1, wherein said lateral sides of said template base comprise opposing parallel sides.

4. The adjustable template of claim 3, wherein said plurality of said template shoes comprises a set of two of said template shoes, one of said template shoes positioned on one of said lateral sides of said template base and the other of said template shoes positioned on said opposing parallel lateral side of said template base.

5. The adjustable template of claim 4, wherein said template shoes on said opposing parallel sides of said template base are adapted to move in tandem with one another.

6. The adjustable template of claim 1, wherein said means for adjusting the position of said template shoes comprises a linkage mechanism.

7. The adjustable template of claim 6, wherein said linkage mechanism comprises a ball screw mechanism.

8. The adjustable template of claim 6, wherein said linkage mechanism is in driving connection with two of said template shoes whereby said two template shoes move in tandem with one another.

9. The adjustable template of claim 1, wherein said means for adjusting the position of said template shoes comprises drive means.

10. The adjustable template of claim 9, wherein said drive means powers said linkage mechanism to maneuver said plurality of said template shoes to a predetermined distance from said lateral edges of said textile product.

11. The adjustable template of claim 9, further comprising a controller for activating said drive means in response to said determination of said length and width of said textile product.

12. The adjustable template of claim 9, wherein said drive means comprises a reversible motor.

13. An adjustable template for maneuvering a textile product having lateral edges along a predetermined path, comprising:

a template base positioned along said predetermined path;

a plurality of adjustable arms slidably attached to said template base, at least two of said adjustable arms forming a set of opposing arms;

a plurality of template shoes, one of said template shoes mounted on each said adjustable arm of said set of opposing arms;

each said adjustable arm of said set of opposing arms connected by a linkage mechanism; and drive means powering said linkage mechanism such that each adjustable arm of said set of opposing arms is maneuvered in tandem with one another to position said template shoes with respect to said template base.

14. The adjustable template of claim 13, wherein said drive means power said linkage mechanism to maneuver said template shoes to a predetermined distance from said lateral edges of said textile product.

15. The adjustable template of claim 13, wherein said linkage mechanism comprises a ball screw mechanism.

16. The adjustable template of claim 13, wherein said drive means comprise a reversible motor.

17. The adjustable template of claim 13, further comprising an optical sensor adapted to be positioned on said predetermined path for determining the length and width of said textile product.

18. The adjustable template of claim 17, further comprising a controller for activating said drive means in response to said determination of said length and width of said textile product.

19. A method for adjusting a template according to the size of a textile product, comprising the steps of:

providing a template comprising a plurality of adjustable template shoes slidably attached to a template base;

detecting the length and width of said textile product; and adjusting the position of said template shoes with respect to said template base according to said detection of said length and width of said textile product.

20. The method of claim 19, wherein said step of detecting the length and width of said textile product comprises detecting said length and said width by optical sensors.

21. The method of claim 19, further comprising the steps of:

contacting said textile product with said template; and moving said textile product along a predetermined path.

* * * * *